US009139343B2

(12) United States Patent
Neiner

(10) Patent No.: US 9,139,343 B2
(45) Date of Patent: Sep. 22, 2015

(54) CAN COMPRISING A FIRST, DISPENSE OPENING AND SECOND, VENT OPENING

(71) Applicant: Anheuser-Busch InBev S.A., Brussels (BE)

(72) Inventor: Christopher Neiner, Newtown, PA (US)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 14/370,755

(22) PCT Filed: Dec. 21, 2012

(86) PCT No.: PCT/EP2012/076818

§ 371 (c)(1),
(2) Date: Jul. 3, 2014

(87) PCT Pub. No.: WO2013/124019

PCT Pub. Date: Aug. 29, 2013

(65) Prior Publication Data

US 2014/0374419 A1 Dec. 25, 2014

(30) Foreign Application Priority Data

Jan. 3, 2012 (EP) ..... 12150043

(51) Int. Cl.
*B65D 51/16* (2006.01)
*B65D 17/00* (2006.01)

(52) U.S. Cl.
CPC ..... *B65D 51/1677* (2013.01); *B65D 17/165* (2013.01); *B65D 2517/0014* (2013.01); *B65D 2517/0094* (2013.01)

(58) Field of Classification Search
CPC .. B65D 17/165; B65D 17/163; B65D 17/161; B65D 17/16; B65D 2517/0013; B65D 2517/0014; B65D 2517/0016; B65D 51/1677; B65D 51/1683; B65D 51/1672; B65D 51/16; B21D 51/383; B21D 51/38
USPC ..... 220/271, 272, 273, 270, 269, 268, 266, 220/265, 906; 413/67, 16, 15, 14, 12, 8
See application file for complete search history.

(56) References Cited

U.S. PATENT DOCUMENTS 3,307,737 A 3/1967 Harvey et al.
3,326,406 A 6/1967 Brown (Continued)

FOREIGN PATENT DOCUMENTS

CA 2 280 461 11/2001
JP 09-301364 11/1997

(Continued)

*Primary Examiner* — Robert J Hicks
(74) *Attorney, Agent, or Firm* — Levy & Grandinetti

(57) ABSTRACT

A can for containing a liquid having a top end with (a) a dispense area defined by a first score line and (b) a pull tab coupled to the top end by a first rivet. The pull tab punctures the dispense area to open a dispense aperture upon lifting an actuating end of the pull tab. The top end has (c) a vent area defined by a second score line and (d) a secondary lever coupled to the top end by a second rivet, and has a puncturing end for puncturing the vent area to open a vent aperture upon lifting an opposite, actuating end of the secondary lever. The secondary lever and pull tab interlock so lifting the actuating end of the pull tab triggers lifting of the actuating end of the secondary lever, opening both dispensing and vent apertures in a single movement.

14 Claims, 2 Drawing Sheets

(56) References Cited

U.S. PATENT DOCUMENTS

| | | | |
|---|---|---|---|
| 4,213,538 | A | 7/1980 | Boardman |
| 5,397,014 | A | 3/1995 | Aydt |
| 5,494,184 | A | 2/1996 | Noguchi et al. |
| 5,695,085 | A | 12/1997 | Hadener |
| 2003/0098306 | A1 | 5/2003 | Cho |
| 2003/0189045 | A1 | 10/2003 | Hwang |
| 2010/0018976 | A1 | 1/2010 | Christian et al. |
| 2011/0056946 | A1 | 3/2011 | Emanuele, III et al. |
| 2011/0132939 | A1 | 6/2011 | Brooks |

FOREIGN PATENT DOCUMENTS

| | | |
|---|---|---|
| JP | 10-245032 | 9/1998 |
| WO | WO 2004/035399 | 4/2004 |
| WO | WO 2008/023983 | 2/2008 |
| WO | WO 2009/078738 | 6/2009 |
| WO | WO 2010/046516 | 4/2010 |

CAN COMPRISING A FIRST, DISPENSE OPENING AND SECOND, VENT OPENING

This Application is the U.S. National Phase of International Application Number PCT/EP2012/076818 filed on Dec. 21, 2012, which claims priority to European Application Number 12150043.3 filed on Jan. 3, 2012.

TECHNICAL FIELD

The present invention relates to the field of cans for containing a liquid. In particular, it concerns beverage cans, such as beer, soda, tonic and the like, comprising a first dispensing aperture and a second vent aperture, wherein both apertures can be opened in a single movement.

BACKGROUND FOR THE INVENTION

Beverage cans have been on the market for several decades, undergoing a series of evolutions, such as the progressive passage from a "detachable pull tab," wherein a closed loop scored section is coupled to a pull tab, to a "push-in tab" type, wherein no element is detached from the can upon opening. Since in both instances an actuating end of a tab must be pulled off the plane formed by the can top end to open a dispense area, such tabs are herein referred to indiscriminately as "pull tabs".

Rapidly, it appeared that cans comprising a single, dispense aperture leads to gurgling of the beverage, due to the difficulty for such systems to balance the pressures inside and outside the can upon dispensing. It has been found that providing the can top with a second, vent aperture, spaced apart from the dispense aperture, yielded a much smoother flow of the liquid out of the can, since the pressure inside the can could instantly adapt to the ambient pressure through said vent aperture. Many two-opening can systems were proposed in the art with widely differing opening mechanisms.

U.S. Pat. No. 4,213,538 proposes a can having a can top provided with two score lines forming closed loops defining two areas to be pushed in with a finger or an external tool. An alternative solution is to fix a pull tab to a rivet located between two areas defined by score lines, such that the tab can be tilted both ways to push a first and then a second areas inside the can like a seesaw such as disclosed in U.S. Pat. No. 5,695,085 or U.S. Pat. No. 5,397,014. In some cases, a single pull tab is first pulled up to push in the dispensing area and then pushed back to its initial position and further down to press in the vent area, such as in US2010/0018976, US2011/0056946, WO2009/078738. These systems, however, have the problem that the vent can be accidentally opened in case a pressure is applied onto the tab. To solve this problem, it has been proposed to not align the first and second apertures with the rivet coupling the tab to the can top. This way, after opening the dispensing opening the pull tab must be swiveled about the rivet axis by the corresponding offsetting angle to face the vent area and only then pushed down to press the vent area inside the can such as disclosed in WO2008/023983. In an alternative embodiment, the actuating end of a tab is first pulled up to open the dispense aperture, then swiveled 180° to face the diametrically opposed vent area, the actuating end is pulled up again to open the vent aperture the same way the dispensing aperture was opened, as in U.S. Pat. No. 5,494,184. WO2010/046516 discloses a can comprising a main pull tab and a secondary lever, both fixed to the can top by a single rivet, wherein the secondary lever is brought into puncturing position upon lifting the main pull tab to puncture the dispense area, whereafter the main tab is brought back to its original position, with the secondary lever brought into puncturing position in front of the vent area, which is opened by pressing further down the main pull tab. This system allows to prevent any accidental opening of the vent. All these systems have in common that several movements are required to open both dispense and vent openings, which is rather inconvenient, in particular when the user has only one hand free to open a can.

Solutions for opening both dispense and vent apertures in a single movement have been proposed in the art. U.S. Pat. No. 3,307,737 discloses a single pull tab coupled to a dispense and a vent areas each forming a closed loop. By pulling one free end of the pull tab, the vent is first pulled off of the can top, followed by the dispense area. The inconvenience of this rather old system is well known in that it generates waste which generally ends up on the ground and represents both an ecological threat and a source of injuries. CA2280461 proposes to couple with a rivet the ring end of a pull tab to a vent score line forming a closed loop. By pulling up said ring end to puncture the dispense area, the vent area is pulled off of the can top.

This system has the inconvenience that a strong force is needed to pull off the vent area from the can top with no leverage offered by said design. US2003/0098306 proposes an improvement to the foregoing system by providing a second lever hinged to the main pull tab at the level of the rivet of the vent area, so that the main pull tab is pulled by pulling the second lever, thus yielding a higher couple. WO2004/035399 and U.S. Pat. No. 3,326,406 disclose systems wherein a single pull tab is coupled to the can top with a first rivet and to a vent area with a second rivet. Unlike the preceding systems, here both dispense and vent areas are pushed into the can by pulling up the pull tab at a point forming a triangle with the first and second rivets forming acute angles. The leverage is provided by the altitude of the triangle intersecting the line between the two rivets.

The present invention provides yet an alternative solution for opening simultaneously a dispensing and vent apertures with a single movement of the hand.

SUMMARY OF THE INVENTION

The present invention is defined in the appended independent claims. Preferred embodiments are defined in the dependent claims. In particular, the present invention concerns a can for containing a liquid, comprising a top end, said top end comprising:

(a) A dispense area defined on said top end by a first score line, (b) A pull tab coupled to the top end by a first rivet, said pull tab being suitable for puncturing the dispense area to open a dispense aperture upon lifting an actuating end of said pull tab away from the top end, (c) A vent area defined on said top end by a second score line, (d) A secondary lever coupled to the top end by a second rivet, said secondary lever comprising a puncturing end suitable for puncturing the vent area to open a vent aperture upon lifting an opposite, actuating end of said secondary lever away from the top end, Characterized in that, the secondary lever and pull tab are interlocked such that the lifting of the actuating end of the pull tab triggers the lifting of the actuating end of the secondary lever thus yielding the opening of both dispensing and vent apertures in a single move.

In a preferred embodiment, the actuating end of the pull tab comprises an opening and the secondary lever penetrates said opening of the ring pull tab such that the actuating end of the secondary lever rests on top of the pull tab, whilst the puncturing end of said secondary lever is below the pull tab, such that upon lifting the pull tab, the actuating end of the secondary lever resting on an edge of the opening of the pull tab is lifted, thus pressing the puncturing end of the secondary lever against the vent area. For example, the secondary lever can be in the shape of a plate extending between a first and second substantially parallel planes, with a first, puncturing portion comprising the puncturing end and extending along said first plane, and a second, actuating portion comprising the actuating end and extending substantially along said second plane, the first, puncturing portion comprising a hole for receiving the second rivet.

It is preferred that the first and/or second score line does not form a closed loop and wherein upon opening the corresponding dispense and/or vent area is folded inwards about a line joining the two ends of said first and/or second score line. In an alternative embodiment, the first and/or second score line forms a closed loop with a first deep score portion, and a second shallow score portion, and wherein upon opening the corresponding dispense and/or vent area is folded inwards about the shallow score portion of the first and/or second score line.

In a preferred embodiment, the first and second rivets and dispense and vent areas are all substantially aligned on a diameter of the can top end, in a sequence (a) dispense area, (b) first rivet, (c) second rivet, (d) vent area.

In order to further enhance the flow rate of liquid out of the can the dispense area has a dimension (d) along the diameter of the top end passing by the first rivet greater or equal to the radius (R) of the top end. By offsetting the position of the first rivet with respect to the centre of the can top, more surface is liberated for the dispense aperture, which allows to substantially increase and smoothen the flow rate out of the can.

A can according to the present invention is particularly suitable for containing liquids such as alcoholic or non-alcoholic beer or other fermented beverages, soda, tonic, juice, soup, energetic beverages, pre-mixed long drink, and the like. A can according to the present invention is preferably made of aluminium, an aluminium alloy or tin plated steel.

BRIEF DESCRIPTION OF THE FIGURES

For a fuller understanding of the nature of the present invention, reference is made to the following detailed description taken in conjunction with the accompanying drawings in which.

DETAILED DESCRIPTION OF THE INVENTION

As can be seen in FIGS. 1, 2, 4, and 5, a can according to the present invention comprises a top end (1) like traditional cans available in shops to date, with a dispense area (3A) defined on said top end (1) by a first score line (31A), and a pull tab (2A) coupled to the top end 1 by a first rivet (4A). The pull tab (2A) comprises a puncturing end (21A) overlapping the dispense area and an opposite actuating end (22A) which, upon lifting away from the plane of the can top end (1) presses the puncturing end (21A) against the dispense area (3A), breaking the score line (31A) and pushing the dispense area (3A) into the can, thus opening the dispense aperture (13A). It is of course much preferable that upon opening the dispense aperture (13A), neither the pull tab (2A) nor the dispense area (3A) is separated from the can top end (1). This can be achieved either by not closing the path formed by the first score line (31A) or by providing a portion of said first line with a shallower score (i.e., less deep) than the rest of the outline. By either of these ways, upon pressing the puncturing end (21A) of the main pull tab (2A) against the dispense area (3A), the latter will fold about a line between the two ends of the open loop score line, or about the shallower portion of the score line. The dispensing part of the can is quite similar to traditional cans. The gist of the present invention, however, is in the vent area (3B) and secondary lever (2B) for puncturing it open.

The vent area (3B) is defined by a second score line (31B), and is located on the can top end opposite the dispense area (3A) with respect to the first rivet (4A). The vent area (3B) should most preferably not be separated from the can to end (1) upon opening the vent aperture (13B). Like for the dispense area (3A) discussed supra the score line (31B) defining the vent area (3B) should define an open path, or comprise a portion of shallower score, to allow inward folding of the vent area (3B) about said unscored or shallow scored line portion. The vent area (3B) is generally smaller in size than the dispense area (3A), since the former needs only to ensure pressure balance during dispensing of the liquid out of the can and a smooth depressurization upon opening of the can. The vent area (3B) is also preferably located close to the periphery of the can top end (1) to reduce the risk of liquid flowing through the vent aperture (13B) upon tilting the can to dispense the liquid.

Figure 1:
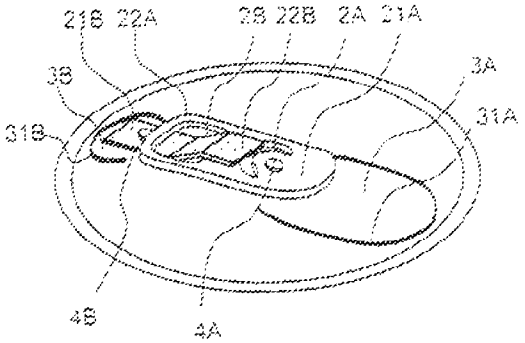
FIG. 1: shows a perspective view of the can top of a can according to the present invention.
Figure 2:
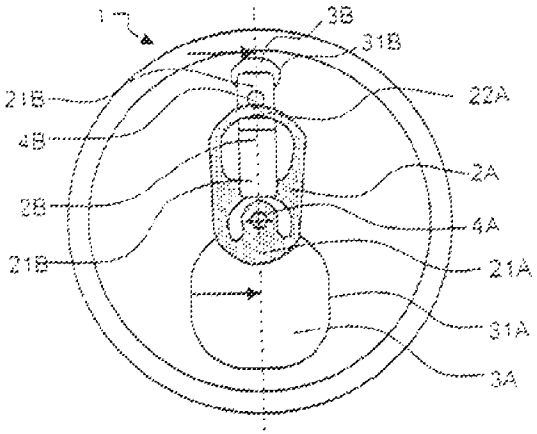
FIG. 2: shows a top view of the can top of a can according to the present invention.
Figure 4:
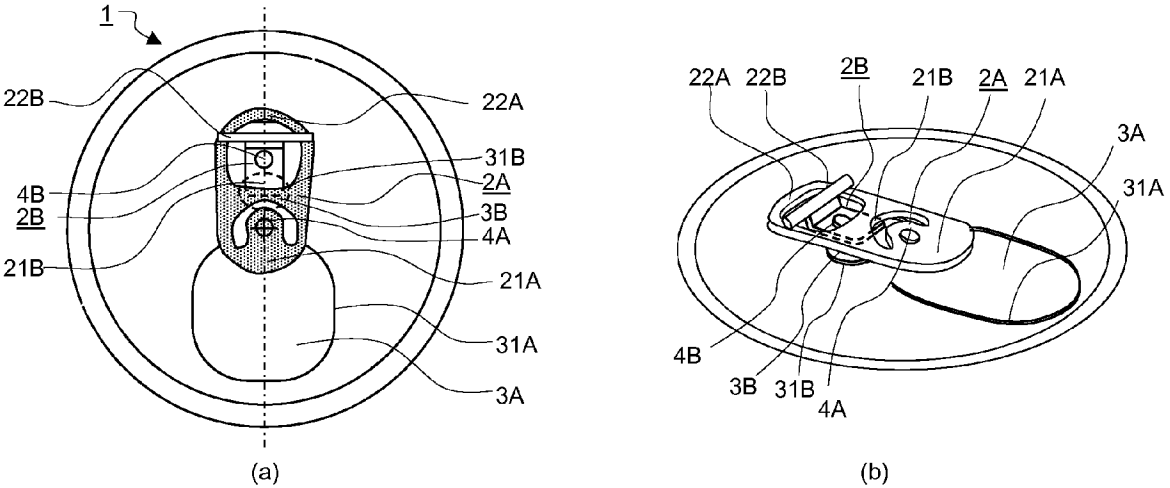
FIG. 4: shows a (a) at top view and (b) a perspective view of the can top of a can according to another embodiment of the present invention.

Opening of the vent aperture (13B) is ensured by a secondary lever (2B) coupled to the top end (1) by a second rivet (4B). The first and second rivets (4A, 4B) and dispense and vent areas (3A, 3B) are preferably substantially aligned on a diameter of the can top end (1). The order can be as illustrated in FIG. 2, in a sequence (a) dispense area (3A), (b) first rivet (4A), (c) second rivet (4B), and (d) vent area (3*b*). Alternatively, as illustrated in FIGS. 4(*a*) and 5(*a*), the first and second rivets (4A, 4B) and dispense and vent areas (3A, 3B) can be substantially aligned on a diameter of the can top end (1), in a sequence (a) dispense area (3A), (b) first rivet (4A), (c) vent area (3B), (d) second rivet (4B). The secondary lever (2B) has an actuating end (22B) and an opposed puncturing end (21B) overlapping the vent area (3B), such that upon lifting the actuating end (22B) of the secondary lever (2B), the puncturing end (21B) thereof applies a pressure against the vent area (38) capable of breaking the second score line (21B) to push and fold the vent area (3B) into the can, thus opening the vent aperture (13B).

Instead of actuating the pull tab (2A) to open the dispense aperture (13A) separately from the secondary lever (2B) to open the vent aperture (13B), and thus require at least two moves to open both apertures, the present invention proposes to interlock the secondary lever (2B) with the pull tab (2A) such that the lifting of the actuating end (22A) of the pull tab (2A) triggers the lifting of the actuating end (22B) of the secondary lever (2B) thus yielding the opening of both dispensing and vent apertures (13A, 13B) in a single move.

Figure 3:
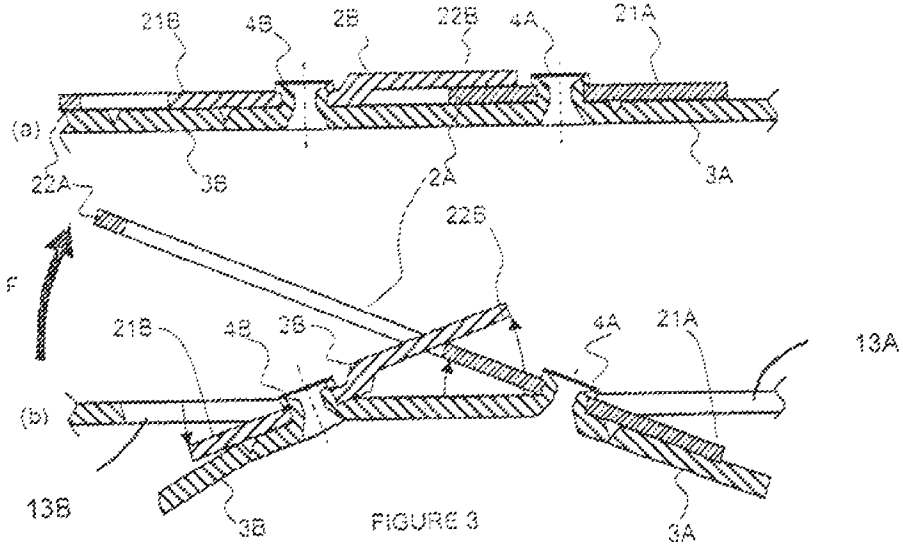
FIG. 3: shows a side view of the can top of a can according to the present invention: (a) in a closed and (b) in an open position.

The interlocking of the secondary lever (2B) and pull tab (2A) can be achieved by providing the actuating end (22A) of the pull tab (2A) with an opening—such as is often present in pull tabs of traditional single aperture cans—and slide the secondary lever (2B) through said opening such that the actuating end (22B) of the secondary lever (2B) rests on top of the pull tab (2A), whilst the puncturing end (21B) and second rivet (4B) of said secondary lever (2B) are positioned below the pull tab (2A). With this configuration, as illustrated in FIG. 3(*b*), the lifting up F of the actuating end (22A) of the pull tab (2A) to open the dispensing aperture (13A) drives upwards the actuating end (22B) of the secondary lever (2B) resting and sliding on an edge of the rising opening of the pull tab (2A) as it is being lifted. The secondary lever (2B), fixed to the can top end by the second rivet (4B) is thus tilted pressing the puncturing end (21B) down against the vent area (3B) until the second score line (31B) breaks to open the vent aperture (13B).

Figure 5:
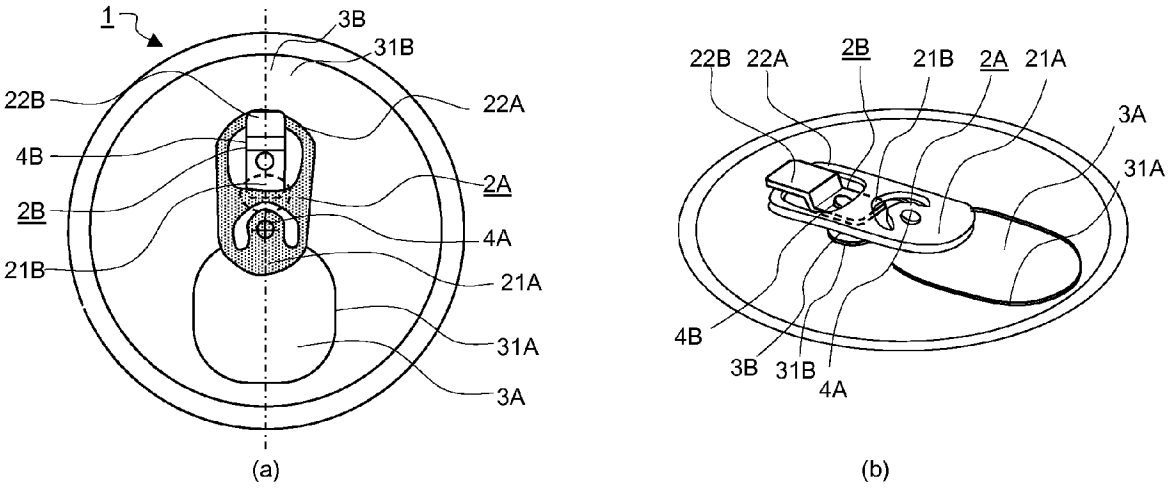
FIG. 5: shows a (a) at top view and (b) a perspective view of the can top of a can according to yet another embodiment of the present invention.

In a preferred embodiment of the above arrangement illustrated in FIGS. 2 and 5, the secondary lever (2B) is in the shape of a plate extending between a first and second substantially parallel planes, with a first, puncturing portion comprising the puncturing end (21B) and extending along said first plane, and a second, actuating portion comprising the actuating end (21B) and extending substantially along said second plane, the first, puncturing portion comprising a hole for receiving the second rivet (4B). The distance between the two planes is substantially equal to the distance between the top surface of the pull tab (2A) and the can top end (1) surface. With this geometry, the actuating portion of the secondary lever (2B) can rest on top of the pull tab (2A) and the puncturing portion of the secondary lever (2B) can lie on the surface of the can top end (1). In a slightly different embodiment illustrated in FIG. 4, the secondary lever (2B) may comprise arms that extend transversely over the pull tab (2A).

In a preferred embodiment, the first rivet (4A) is offset with respect to the centre of the can top end (1). In the preferred embodiment discussed supra wherein the first and second rivets (4A, 4B) and dispense and vent areas (3A, 3B) are preferably substantially aligned on a diameter of the can top end (1), in a sequence (a) dispense area (3A), (b) first rivet (4A), (c) second rivet (4B), (d) vent area (3B), it permits increasing the size of the dispense opening and bringing the vent closer to the outer rim, which is advantageous for the flow rate, as discussed above. For example, the dispense area (3A) can have a dimension (d) along the diameter of the top end (1) passing by the first rivet (4A) greater or equal to the radius (R) of the top end (1).

The present invention allows the provision of a vent aperture (13B) which combined opening with the dispense aperture (13A) can be triggered by the same single move as has been used by generations of end users with traditional single aperture cans. Contrary to the solution proposed in CA2280461, the force required to open both openings is not much different from the one required to open traditional single aperture cans, because the geometry of the opening system of the present invention allows for a substantial leverage effect. For example, it is possible to open both apertures of a can according to the present invention in a single move with one hand only.

A can according to the present invention is particularly suitable for containing beverages. For example, alcoholic or non-alcoholic beer or other fermented beverages, such as cider, low malt content beer like beverages, sparkling wine, and the like, soda, tonic, juice, energetic beverages, premixed long drinks of a spirit and a soda, milk, condensed milk, soup, sauce, and the like. The can may be made of aluminium, an aluminium alloy or tin plated steel.

The invention claimed is:

1. A can for containing a liquid comprising a top end, said top end comprising:

(a) a dispense area defined on said top end by a first score line, (b) a pull tab coupled to the top end by a first rivet, said pull tab being suitable for puncturing the dispense area to open a dispense aperture upon lifting an actuating end of said pull tab away from the top end, (c) a vent area defined on said top end by a second score line, and (d) a secondary lever coupled to the top end by a second rivet, said secondary lever comprising a puncturing end suitable for puncturing the vent area to open a vent aperture upon lifting an opposite, actuating end of said secondary lever away from the top end, wherein the secondary lever and pull tab are interlocked such that the lifting of the actuating end of the pull tab triggers the lifting of the actuating end of the secondary lever thus yielding the opening of both dispensing and vent apertures in a single move.

2. The can according to claim 1, wherein the actuating end of the pull tab comprises an opening and the secondary lever penetrates said opening of the pull tab such that the actuating end of the secondary lever rests on top of the pull tab, whilst the puncturing end of said secondary lever is below the pull tab, such that upon lifting the pull tab, the actuating end of the secondary lever resting on an edge of the opening of the pull tab is lifted, thus pressing the puncturing end of the secondary lever against the vent area.

3. The can according to claim 2, wherein the secondary lever is in the shape of a plate extending between a first and second substantially parallel planes, with a first, puncturing portion comprising the puncturing end and extending along said first plane, and a second, actuating portion comprising the actuating end and extending substantially along said second plane, the first, puncturing portion comprising a hole for receiving the second rivet.

4. The can according to claim 3, wherein the first and/or second score line does not form a closed loop and wherein upon opening the corresponding dispense and/or vent area is folded inwards about a line joining the two ends of said first and/or second score line.

5. The can according to claim 3, wherein the first and/or second score line forms a closed loop with a first deep score portion, and a second shallow score portion, and wherein upon opening the corresponding dispense and/or vent area is folded inwards about the shallow score portion of the first and/or second score line.

6. The can according to claim 5, wherein the first and second rivets and dispense and vent areas are substantially aligned on a diameter of the can top end, in a sequence (a) dispense area, (b) first rivet, (c) second rivet, (d) vent area or, alternatively, in a sequence (a) dispense area, (b) first rivet, (c) vent area, (d) second rivet.

7. The can according to claim 6, wherein the dispense area has a dimension (d) along the diameter of the top end passing by the first rivet greater or equal to the radius (R) of the top end.

8. The can according to claim 7 made of aluminum, an aluminum alloy or tin plated steel.

9. The can according to claim 1, wherein the first and/or second score line does not firm a closed loop and wherein upon opening the corresponding dispense and/or vent area is folded inwards about a line joining the two ends of said first and/or second score line.

10. The can according to claim 1, wherein the first and/or second score line forms a dosed loop with a first deep score portion, and a second shallow score portion, and wherein upon opening the corresponding dispense and/or vent area is folded inwards about the shallow score portion of the first and/or second score line.

11. The can according to claim wherein the first and second rivets and dispense and vent areas are aligned on a diameter of the can top end, in a sequence (a) dispense area, (b) first rivet, (c) second rivet, (d) vent area or, alternatively, in a sequence (a) dispense area, (b) first rivet, (c) vent area, (d) second rivet.

12. The can according to claim wherein the dispense area has a dimension (d) along the diameter of the top end passing by the first rivet greater or equal to the radius (R) of the top end.

13. The can according to claim 1 made of aluminum, an aluminum alloy or tin plated steel.

14. A can according to claim 1, containing a liquid consisting of a beverage selected from the group of alcoholic or non-alcoholic beer or other fermented beverages, soda, tonic, juice, energetic beverages, soup, long drink.

* * * * *